US011215007B2

(12) United States Patent
Schorling

(10) Patent No.: US 11,215,007 B2
(45) Date of Patent: Jan. 4, 2022

(54) ROLLER SHUTTER WHICH IS CONVENIENT TO MOUNT

(71) Applicant: HD4U SMART HOME CO., LTD., Zhejiang (CN)

(72) Inventor: Stefan Herman Georg Schorling, Zhejiang (CN)

(73) Assignee: HD4U SMART HOME CO., LTD., Zhejiang (CN)

( * ) Notice: Subject to any disclaimer, the term of this patent is extended or adjusted under 35 U.S.C. 154(b) by 263 days.

(21) Appl. No.: 16/030,874

(22) Filed: Jul. 10, 2018

(65) Prior Publication Data

US 2018/0355664 A1 Dec. 13, 2018

Related U.S. Application Data

(63) Continuation-in-part of application No. PCT/CN2017/070595, filed on Jan. 9, 2017.

(30) Foreign Application Priority Data

Jan. 11, 2016 (CN) ..... 201610017977.3

(51) Int. Cl.
*E06B 9/42* (2006.01)
*E06B 9/40* (2006.01)
*E06B 9/50* (2006.01)

(52) U.S. Cl.
CPC ..... *E06B 9/40* (2013.01); *E06B 9/42* (2013.01); *E06B 9/50* (2013.01); *E06B 2009/407* (2013.01)

(58) Field of Classification Search
CPC ..... E06B 9/40; E06B 9/42; E06B 9/50; E06B 9/72; E06B 9/78; E06B 2009/407; A47H 1/13
See application file for complete search history.

(56) References Cited

U.S. PATENT DOCUMENTS 1,057,603 A * 4/1913 Whitney ..... E06B 9/90 160/301
1,232,729 A * 7/1917 Stam ..... E06B 9/50 248/268
2,974,805 A * 3/1961 Brossean ..... A47H 1/022 211/105.5
4,373,569 A * 2/1983 Barettella ..... E06B 9/44 160/263

(Continued)

*Primary Examiner* — Daniel P Cahn
*Assistant Examiner* — Abe Massad
(74) *Attorney, Agent, or Firm* — JCIPRNET

(57) ABSTRACT

A roller shutter which is convenient to mount, comprising a roller shutter body (1) with a rolling pipe (2), wherein a positioning sleeve (41) embedded in the rolling pipe (2) and a retractable fixing assembly (4) located in the positioning sleeve are arranged on at least one end of the roller shutter body (1); the positioning sleeve (41) is fixedly connected to the rolling pipe (2); the positioning sleeve (41) and the retractable fixing assembly (4) can rotate in a relative manner; and the retractable fixing assembly (4) comprises a self-locking retractable mechanism and a retaining plug assembly for bearing against a wall surface to increase a friction force. The roller shutter is convenient to mount and dismount, and the distance between fixed points at two sides of the roller shutter can be adjusted according to the width of a window.

12 Claims, 7 Drawing Sheets

(56) References Cited

U.S. PATENT DOCUMENTS

| | | | | |
|---|---|---|---|---|
| 5,121,110 | A * | 6/1992 | Mahar, Jr | G01B 7/023 248/27.1 |
| 5,961,172 | A * | 10/1999 | Ament | B60R 5/047 160/238 |
| 7,740,047 | B2 * | 6/2010 | Koop | E06B 9/50 160/323.1 |
| 8,408,486 | B2 * | 4/2013 | Di Stefano | E06B 9/42 242/407 |
| 8,695,681 | B2 * | 4/2014 | Daniels | E06B 9/50 160/291 |
| 8,839,841 | B2 * | 9/2014 | Koop | E06B 9/50 160/325 |
| 9,926,740 | B2 * | 3/2018 | Pham | E06B 9/42 |
| 2008/0230185 | A1 * | 9/2008 | Kahn | E06B 9/44 160/23.1 |
| 2010/0200179 | A1 * | 8/2010 | Di Stefano | E06B 9/50 160/368.1 |
| 2014/0084122 | A1 * | 3/2014 | Shevick | F16M 13/02 248/268 |
| 2018/0291682 | A1 * | 10/2018 | Walter-Seifart | E06B 9/40 |

* cited by examiner

ROLLER SHUTTER WHICH IS CONVENIENT TO MOUNT

CROSS-REFERENCE TO RELATED APPLICATION

This is a continuation-in-part application of International Application No. PCT/CN2017/070595, filed on Jan. 9, 2017, which claims the priority benefits of China Application No. 201610017977.3, filed on Jan. 11, 2016. The entirety of each of the above-mentioned patent applications is hereby incorporated by reference herein and made a part of this specification.

BACKGROUND OF THE INVENTION

Technical Field

The present invention relates to a window curtain, in particular to a rolling shutter with convenient installation.

Background

The existing rolling shutter is fixed to walls of both sides of a window edge through screws. The fixation of this kind of rolling shutter is complicated, and needs to use additional tool for operation, and the walls shall be drilled, destroying wall surfaces. And for the present windows, in many cases, there are certain differences in the size of each window, which is not exactly the same. Hence, the installation size of the curtain requires actual measurements, and it cannot be adjusted. When the length of the rolling shutter is greater than the width of the window, the rolling shutter cannot be installed between the walls on both sides of the window. When the length of the rolling shutter is less than the width of the window, both ends of the rolling shutter cannot be attached to the walls on both sides of the window for fixation.

SUMMARY

In view of the above problems, the present invention provides a rolling shutter capable of facilitating assembly and disassembly, shortening disassembling and assembling time, regulating a distance between fixed points on both sides of the rolling shutter according to the width of a window, and enhancing the scope of application of the width of the rolling shutter.

The purpose of the present invention is mainly achieved through the following solution: A rolling shutter with convenient installation comprises a rolling shutter body with a rolling pipe; at least one end of the rolling shutter body is provided with a locating sleeve embedded into the rolling pipe and a telescopic fixing component located in the locating sleeve; the locating sleeve is fixedly connected with the rolling pipe; the locating sleeve and the telescopic fixing component can rotate relatively; and the telescopic fixing component comprises a telescopic component for self-locking and a fixing plug component. Shutter fabric is rolled on the rolling pipe. Rotation of the rolling pipe drives the shutter fabric to roll and drop. The locating sleeve is disposed at the end of the rolling shutter body. The telescopic fixing component is disposed in the locating sleeve. By extending or inward retracting the telescopic fixing components, the distance between the two ends of the curtain is extended or shortened to adapt to the size of the rolled curtains with different widths to meet the size gap on different windows. The range of fine tuning is generally kept at about 1 cm. The telescopic fixing component comprises a telescopic component and a fixing plug component. The telescopic component can enable the fixing plug component to partially extend outwards or contract inwards, so as to compensate for width discrepancies brought by different window widths. The telescopic component part is regulated according to the widths of the windows so that the fixing plug component is pressed on a wall. The rolling shutter is fixed by means of frictional force between the fixing plug component and a wall surface. After the telescopic component part is regulated completely, the telescopic component can be fixed through a self-locking function of the telescopic component and then the whole rolling shutter is fixed. When the rolling shutter needs to be disassembled, the telescopic component part is only regulated to contract, i.e., the fixing plug component part moves to a direction away from the wall surface so as to realize disassembly of the rolling shutter. In assembly and disassembly processes, only the telescopic component part is regulated, so operation is simple, drilling for installing a screw is not needed and the wall surface is not damaged.

Preferably, a bearing for reducing rotating frictional force is disposed between the locating sleeve and the telescopic fixing component. The locating sleeve is fixedly connected with the rolling pipe. When the fixing plug component is pressed against the wall surface, the wall surface exerts a reacting force to the fixing plug component and the telescopic component. The bearing is disposed between the locating sleeve and the telescopic fixing component to enable the locating sleeve and the telescopic fixing component to rotate relatively. Moreover, bearing can be used for reducing rotating frictional force between the locating sleeve and the telescopic fixing component. Even if the telescopic fixing component bears the reacting force of the wall surface, the locating sleeve can also rotate along with the rolling pipe.

Preferably, both end of the rolling shutter body is provided with a locating sleeve, a telescopic fixing component located in one side locating sleeve, the other end is provided with a locating component, a bearing is disposed between the locating sleeve and the telescopic fixing component, a bearing is disposed between the locating sleeve and the locating component.

Preferably, a thrust spring is disposed between the telescopic component and the fixing plug component. The setting of the thrust spring is to use the force of the thrust spring to locate the rolling shutter body directly according to the width of the window, and then adjust the telescopic component to press the fixing plug component on both sides of the wall, so that the whole rolling curtain is fixed.

Preferably, one end of the rotating sleeve close to the fixing plug component is connected with a turntable. The turntable can be integrated with the rotating sleeve, and the turntable and the rotating sleeve can also be connected through a connecting piece, such as through screws or pins. The rotating sleeve is rotated by rotating the turntable. The turntable is hand gripped for adjustment to facilitate the operator to exert external force on the rotary sleeve.

Preferably, the telescopic component comprises a rotating sleeve located in the locating sleeve and a screw cylinder located in the rotating sleeve; the screw cylinder is in thread connection with the rotating sleeve and realize self locking; the fixing plug component is located in the screw cylinder, a thrust spring is disposed between the fixing plug component and the screw cylinder. The locating sleeve is embedded into the rolling pipe. The rotating sleeve is disposed in the locating sleeve. The rotating sleeve and the locating sleeve can rotate relatively. The self locking of the telescopic component is realized through the thread between the screw cylinder and the rotating sleeve. The rotation of the rotating sleeve drives the screw cylinder to rotate, and then the screw cylinder is rotated out of the rotating sleeve. The screw cylinder is rotated and the fixed plug is pressed against the wall. At this time, the screw cylinder and the rotating sleeve are relatively stationary through the self locking, so the rolling curtain is fixed. One end of the thrust spring is abutted against the bottom of the screw cylinder, and the other end of the thrust spring is abutted against the fixing plug component. The thrust spring is located inside the screw cylinder. When the rolling curtain is installed, the roll curtain is loaded into the wall on both sides of the window, and the fixing plug component assembly is driven by the force of the thrust spring. The fixing plug component is connected with the wall to position, and then rotate the rotating sleeve, so that the screw cylinder moves in the direction of the fixing plug component, so that the fixing plug component is pressed against the wall surface. There is a gap between the screw cylinder and the locating sleeve. The rotation of the screw cylinder presses the fixing plug component to the wall, and the rolling pipe fixed on the locating sleeve does not follow the motion of the screw cylinder. The two are relatively independent. Therefore, the use of telescopic components and the fixing plug component to realize the rolling shutter fixation and disassembly will not affect the rolling shutter body. When the rolling shutter needs to be disassembled, the rotating sleeve is rotated backwards so that the thrust is disappearing on the fixing plug component, the screw cylinder drives the fixing plug components to contract so as to decrease the total length of the whole shutter, thereby realizing disassembly of the rolling shutter. Fixation and disassembly operations are simple. Fixation and installation of the rolling shutter reduces the time required for assembly and disassembly. The rolling shutter can adapt to windows of different widths.

Preferably, the fixing plug component comprises a fixing rod cylinder located in the screw cylinder, a locating disk connected with the fixing rod cylinder, and a locating plug fixed to the locating disk or the fixing rod cylinder. The locating disk, the fixing rod cylinder and the locating plug are relatively stationary. The locating plug can be fixed on the locating disk and also can be fixed on the fixing rod cylinder. Each of the component of the fixing plug component moves together. A cavity is formed in the center of the fixing rod cylinder. The thrust spring is put into the cavity in the center of the fixing rod cylinder. A cavity is also formed in the center of the screw cylinder. The fixing rod cylinder is put into the cavity in the center of the screw cylinder. An opening of the cavity in the center of the fixing rod cylinder is disposed oppositely to an opening of the cavity in the center of the screw cylinder, thereby forming a cavity body capable of accommodating the thrust spring. The end surface of the locating disk is connected with the end surface of the screw cylinder, so that the telescopic components to exert pressure on the locating plug, the screw cylinder abuts against the edge of locating disk, and the fixing plug is pressed against the wall surface by the friction force between the locating disk and the screw cylinder, so that the rolling curtain is fixed. The configuration of locating plug is used to increase the frictional force between the locating plug and the wall, increasing the stability of fixing the roller curtain.

Preferably, the rolling shutter body is a manual bead curtain with a bead chain; and both ends of the rolling shutter body are provided with telescopic fixing components.

The rolling shutter body may also be an electric rolling shutter with a motor; one end of the rolling shutter body is provided with a telescopic fixing component; the other end is provided with a locating component; the locating component comprises a locating seat, and a second locating plug fixedly connected with one end of the locating seat, and a driving wheel fixedly connected with the other end of the locating seat; the driving wheel fixedly connected with the rolling pipe, a rotating seat is disposed between the locating seat and the rolling pipe; and a second bearing is disposed between the locating seat and the rotating seat. The motor is disposed in the rolling pipe of the rolling shutter body. The motor drives the rolling pipe to rotate, and then drives the shutter fabric to roll and drop. One end of the rolling shutter body is provided with the telescopic fixing component, and the other end is provided with the locating component. One end of the locating component is abutted against the wall. The telescopic fixing component on the other end is regulated to realize the fixation of the rolling shutter body. When the motor rotates, the motor drives the driving wheel to rotate, the driving wheel fixedly connected with the rolling pipe. The driving wheel drives the rolling pipe to rotate. Because the second bearing is disposed between the rotating seat and the locating seat, when the rotating seat is rotated, the locating seat and the second locating plug at the end of the locating seat are always abutted against the wall. The structure of the second locating plug on the locating component is the same as the structure of the locating plug of the telescopic component.

Preferably, one end of the fixing rod cylinder is provided with an elastic hook column; an elastic hook is arranged at the end of the elastic hook column; the other end of the fixing rod cylinder is formed with the locating disk; the elastic hook of the fixing rod cylinder successively penetrates through the through holes in the centers of the screw cylinder, the rotating sleeve and the locating sleeve and is clamped on the end of the locating sleeve; and the thrust spring is sleeved on the elastic hook column. The diameter of the elastic hook column is less than the diameter of the fixing rod cylinder. One end of the thrust spring is abutted against the bottom of the cavity in the center of the screw cylinder, and the other end of the thrust spring is abutted against the lower end surface of the fixing rod cylinder. The lower end surface of the fixing rod cylinder is the end surface that connects the fixing rod cylinder and the elastic hook column. The fixing rod cylinder can be effectively prevented from dropping from the thread sleeve, and installation stability is enhanced.

Preferably, a turntable is arranged at one end of the rotating sleeve close to the fixing plug component; threads are arranged on the outer circumferential surface of the locating disk; a thread sleeve is connected to the outer threads of the locating disk; and the end surface of the thread sleeve is connected with the end surface of the turntable. The fixing plug component is pushed to the wall direction by the thrust spring thrust, and the rotating disk is rotated after the fixing of the two ends of the rolling shutter, the screw cylinder is rotated and the fixed plug component is pressed against the wall, and the friction between the fixed plug component and the wall is used to achieve the fixation of the two ends of the rolling shutter. Then, rotate the thread sleeve, the end surface of the thread sleeve is connected with the end surface of the turntable. The frictional force between thread sleeve and turntable is used to prevent the turntable from rotating. At the same time, the thread sleeve can be used to block the gap between the turntable and the locating disk.

Preferably, the external diameter of the thread sleeve is not greater than the external diameter of the turntable; and the direction that the turntable screws out the screw cylinder from the rotating sleeve is consistent with the rotating direction when the thread sleeve moves to the direction of the turntable, the thread sleeve is rotated to enable the thread sleeve to move towards the turntable. Thus, the thread sleeve is connected with the end surface of the turntable, and the thread sleeve and the turntable are locked by means of the frictional force therebetween. When the thread sleeve continues to be rotated, if the thread sleeve is rotated clockwise, then, at the same time, the turntable is also rotated clockwise. The turntable rotating in clockwise causes the screw cylinder to be rotated out of the rotating sleeve to enable the screw cylinder to move towards the locating disk, thereby the locating plug is further pressed toward the wall direction. Therefore, the rotating direction in which the thread sleeve locks the turntable is consistent with the rotating direction in which the turntable after rotation compacts the locating disk. Therefore, the whole structure is more stable, and the locating plug is pressed against the wall surface more tightly through the locking of the thread sleeve.

Preferably, the locating plug at the end in the fixing plug component comes into contact with a wall surface; and a spherical sucker or friction ring is arranged on the end surface of the locating plug. The locating plug is spherical. When the locating plug is extruded towards the wall, a gap between the locating plug and the wall is reduced, realizing complete bonding between the locating plug and the wall. Absorption between the locating plug and the wall is realized through reasonable use of atmospheric pressure. A plurality of nonskid bulges distributed around the axis of the locating plug are disposed on the end surface of one end of the locating plug away from the locating sleeve, so as to increase the coefficient of friction between the locating plug and the wall and further increase the frictional force between the locating plug and the wall. The structure of the friction ring is a plurality of annular structures which are parallel to each other are disposed on the end surface of the locating plug, so as to enhance the frictional force.

Preferably, the section of the fixing rod cylinder is quadrangular, pentagonal or hexagonal. The section of the fixing rod cylinder is quadrangular, pentagonal or hexagonal, i.e., when the fixing rod cylinder is inserted into the screw cylinder, axial relative rotation between the fixing rod cylinder and the screw cylinder is avoided.

Preferably, the locating plug is spherical, and a plurality of nonskid bulges distributed around the axis of the locating plug are disposed on the end surface of one end of the locating plug away from the locating sleeve. The locating plug is spherical. When the locating plug is extruded towards the wall, a gap between the locating plug and the wall is reduced, realizing complete bonding between the locating plug and the wall. Absorption between the locating plug and the wall is realized through reasonable use of atmospheric pressure. A plurality of nonskid bulges distributed around the axis of the locating plug are disposed on the end surface of one end of the locating plug away from the locating sleeve, so as to increase the friction coefficient between the locating plug and the wall and further increase the frictional force between the locating plug and the wall.

Therefore, the rolling shutter with convenient installation in the present invention has the following advantages: 1) the setting of the thrust spring to use the push force of the thrust spring to extend the fixing plug component out of the screw cylinder, and the distance between the two ends of the rolling pipe is adjusted according to the width of the window to realize the positioning of the rolling shutter body. After the rolling shutter is located, the telescopic component part is regulated to fix the rolling shutter; 2) The rolling shutter is loaded into the wall between the two sides of the window, and the turntable drives the rotating sleeve to rotate, so that the screw cylinder is swirled out on the end face of the fixing plug component and is pressed against the wall by the friction force between the end of the screw cylinder and the locating disk. It is no need to perforate or destroy walls, and directly realize the installation of rolling shutters; 3) The self locking of the telescopic component is realized by using threads between the screw cylinder and the rotating sleeve. The structure is simple and the operation is convenient; 4) By use of the telescopic components and the fixing plug component, fixation and disassembly operation is simple, reduces the time required for assembly and disassembly; 5) The hook column penetrates through the screw cylinder, the rotating sleeve and the locating sleeve; and the axial direction of the locating plug component is fixed to prevent the locating plug component from dropping from the screw cylinder, so that integral stability and installation convenience are enhanced.

Graphic description: 1—rolling shutter body; 2—rolling pipe; 3—bead chain; 4—telescopic fixing component; 41—locating sleeve; 411—supporting rib; 42—rotating sleeve; 43—screw cylinder; 44—thrust spring; 45—turntable; 51—fixing rod cylinder; 52—locating disk; 53—locating plug; 531—friction ring; 54—location column; 55—nonskid bulge; 56—rotating tooth; 57—thread; 58—thread sleeve; 59—elastic hook column; 591—elastic hook; 592—slot; 6—bearing; 61—supporting bearing; 7—locating component; 71—locating seat; 72—second locating plug; 73—driving wheel; 9—rotating seat; 10—wire; 11—second bearing.

DETAILED DESCRIPTION OF THE EMBODIMENTS

The technical solution of the present invention is further described in detail below through embodiments in combination with drawings.

Embodiment 1

Figure 1:
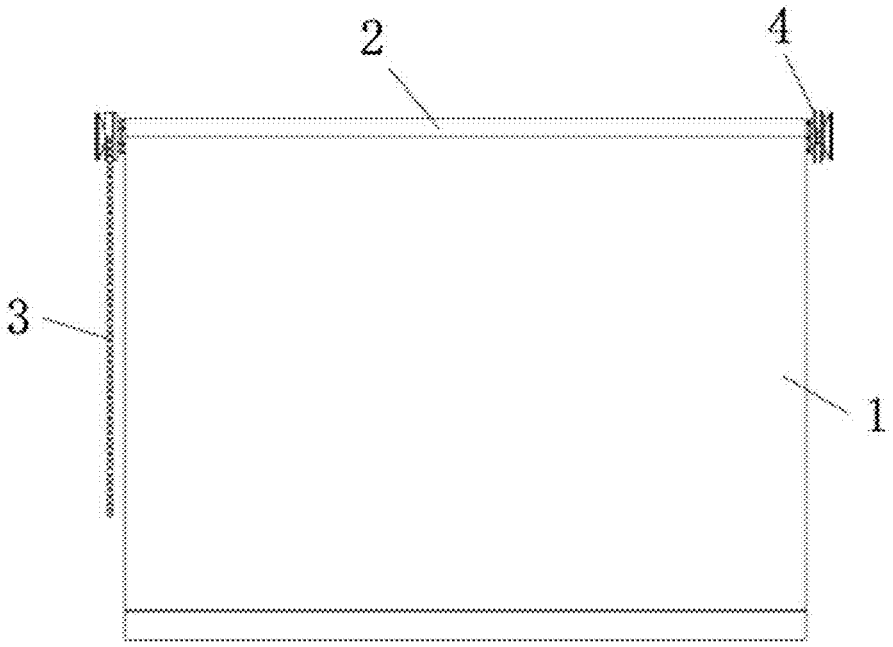
FIG. 1 is a structural schematic diagram in an embodiment 1 of the present invention.
Figure 2:
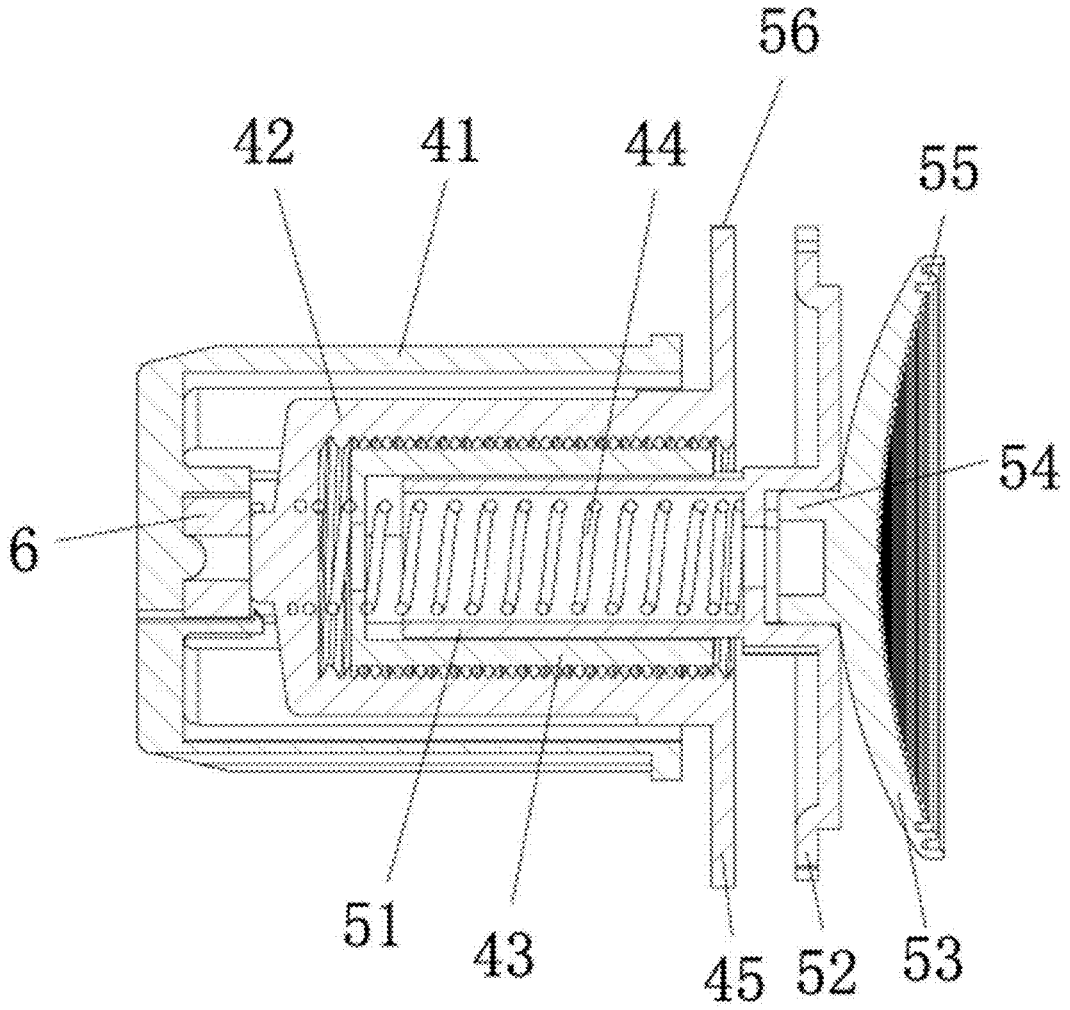
FIG. 2 is a section view of a telescopic fixing component in the present invention.
Figure 3:
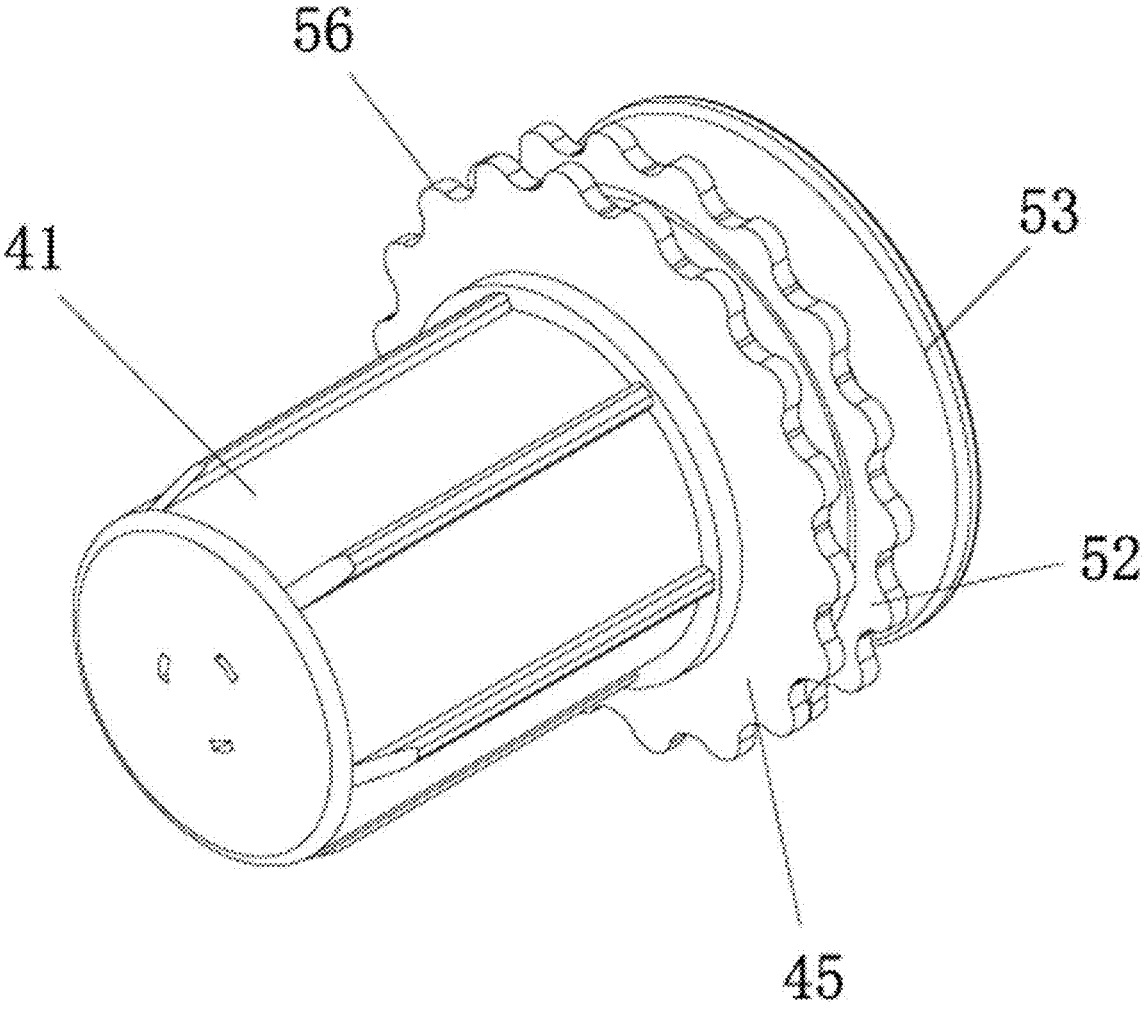
FIG. 3 is a stereogram of FIG. 2.

As shown in FIGS. 1, 2 and 3, a rolling shutter with convenient installation includes a rolling pipe 2, a rolling shutter body 1 is rolled on the rolling pipe. A bead chain 3 is disposed on the one end of the rolling pipe. i.e., the rolling shutter body is a manual bead curtain. The locating sleeve 41 and the telescopic fixing component 4 are embedded at the end of the rolling pipe.

The telescopic fixing component comprises a telescopic component and a fixing plug component. The telescopic fixing component 4 comprises: a rotating sleeve 42, a screw cylinder 43, a fixing rod cylinder 51, a locating disk 52, a locating plug 53 and a thrust spring 44. the rotating sleeve 42 and a locating sleeve 41 are arranged in coaxial lines. A bearing 6 is arranged between the locating sleeve and the rotating sleeve 42, and the rotating is located inside the locating sleeve, and the rotating sleeve 42 and the locating sleeve 41 and can be rotated relatively. One end of the rotating sleeve close to the fixing plug component is provided with the turntable 45, and the turntable is integratedly connected with the rotating sleeve. The outer diameter of the turntable is larger than the outer diameter of the locating sleeve. Turn the turntable to drive the rotating sleeve 42 to rotate. A cavity is formed in the interior of the rotating sleeve 42, and an internal thread is disposed on the inner wall of the cavity, and the screw cylinder 43 is connected by an internal thread. The center of the screw cylinder also has a cavity in which the fixing rod cylinder 51 is inserted. A cavity is formed in the center of the fixing rod cylinder 51, and the screw cylinder is connected with the cavity of the fixing rod cylinder to form a closed cavity. A thrust spring 44 is disposed within the cavity. The other end of the fixing rod cylinder 51 is integrally formed with a locating disk 52 which coincides with the outer diameter of the turntable 45. Rotating teeth 56 are provided on the edges of the turntable and the locating plate. A locating square hole is formed at an axis of the locating disk; one end of the locating plug close to the locating disk 53 is provided with a locating column 54 matched with the locating square hole. The section of the fixing rod cylinder is hexagonal. The locating plug is spherical, and a plurality of nonskid bulges 55 distributed around the axis of the locating plug are disposed on the end surface of one end of the locating plug away from the locating sleeve.

When the rolling shutter is not used, the locating plug component is inserted into the screw cylinder and the thrust spring is in a natural state. When the rolling shutter needs to be installed, the fixing rod cylinder in the locating plug component is in clearance fit with the screw cylinder; the end of the fixing rod cylinder is abutted against the thrust spring; The thrust of the thrust spring presses the fixing plug component to the direction of the wall to realize the positioning of the rolling shutter. Then, the turntable is rotated; the rotating sleeve formed integrally with the turntable is located in the locating sleeve; the rotating sleeve is also in clearance fit with the locating sleeve; the turntable rotates to drive the rotating sleeve to rotate; the rotating sleeve is in thread fit with the screw cylinder, so as to drive the screw cylinder to move axially; thus, the screw cylinder moves towards the locating disk, thereby further compressing the locating plug component to the wall; so as to fix the end of the rolling shutter. When the rolling shutter needs to be disassembled, the turntable is rotated in the reverse direction, the screw barrel shrinks into the slewing sleeve 42, thereby eliminating the pressure of the exerted on the positioning disc 52. The fixed rod cylinder 51 move in the screw cylinder so as to decrease the total length of the whole shutter, thereby realizing disassembly of the rolling shutter. Fixation and disassembly operations are simple. Fixation and installation of the rolling shutter reduces the time required for assembly and disassembly. The rolling shutter can adapt to windows of different widths. The section of the fixing rod cylinder is hexagonal, i.e., the fixing rod cylinder is inserted into the screw cylinder to avoid axial relative rotation between the fixing rod cylinder and the screw cylinder. The locating plug is a spherical rubber plug. When the locating plug is extruded towards the wall, a gap between the locating plug and the wall is reduced, realizing complete bonding between the locating plug and the wall. Suction between the locating plug and the wall is realized through reasonable use of atmospheric pressure. At the same time, the locating plug is used to increase the frictional force between the locating plug and the wall, thereby realizing fixation of the fixing plug component and further realizing fixation of the whole rolling shutter. A plurality of nonskid bulges distributed around the axis of the locating plug are disposed on the end surface of one end of the locating plug away from the locating sleeve, so as to increase the coefficient of friction between the locating plug and the wall and further increase the frictional force between the locating plug and the wall. One end of the locating sleeve away from the fixing plug component is provided with the bearing, and the bearing can realize rotation between the rotating sleeve and the locating sleeve. When the rotating sleeve, together with the fixing plug component, is fixed with the wall, the locating sleeve still can rotate with the rolling pipe. The bearing is used to reduce rotation frictional force between the rotating sleeve and the locating sleeve, so as to avoid influencing the rotation of the rolling pipe.

Embodiment 2

Figure 4:
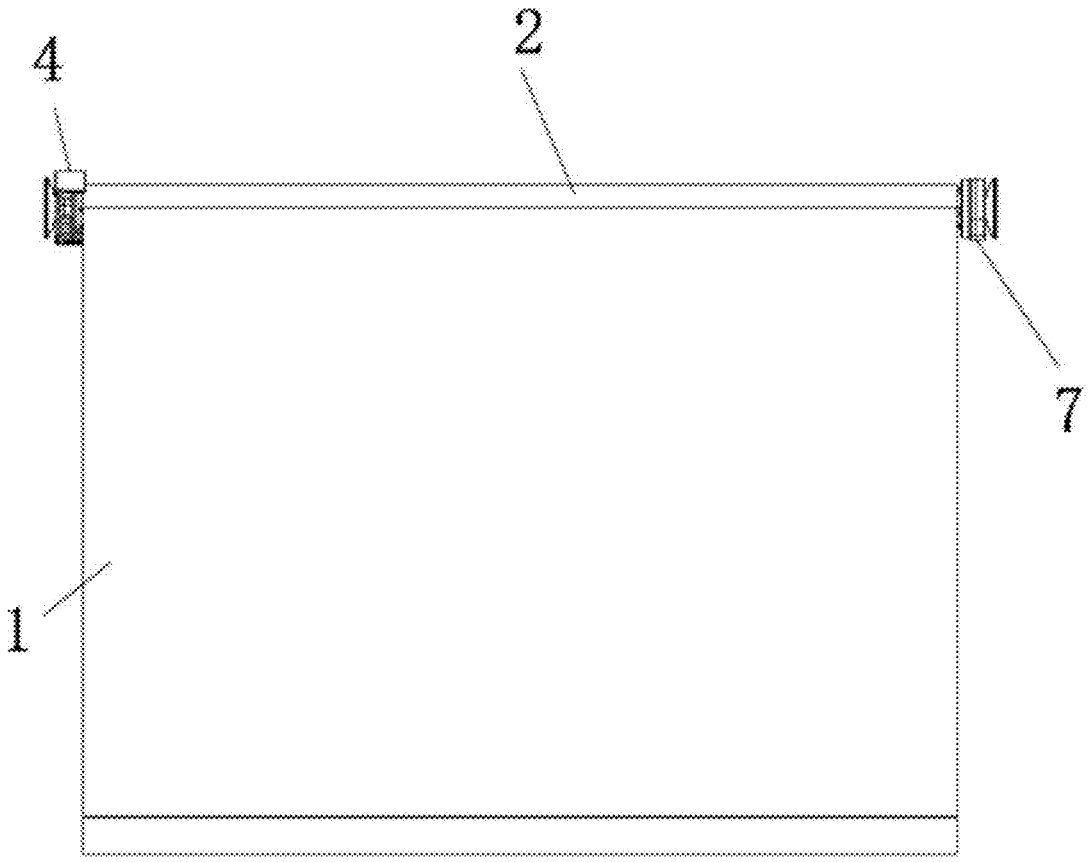
FIG. 4 is a structural schematic diagram of an embodiment 2 in the present invention.
Figure 5:
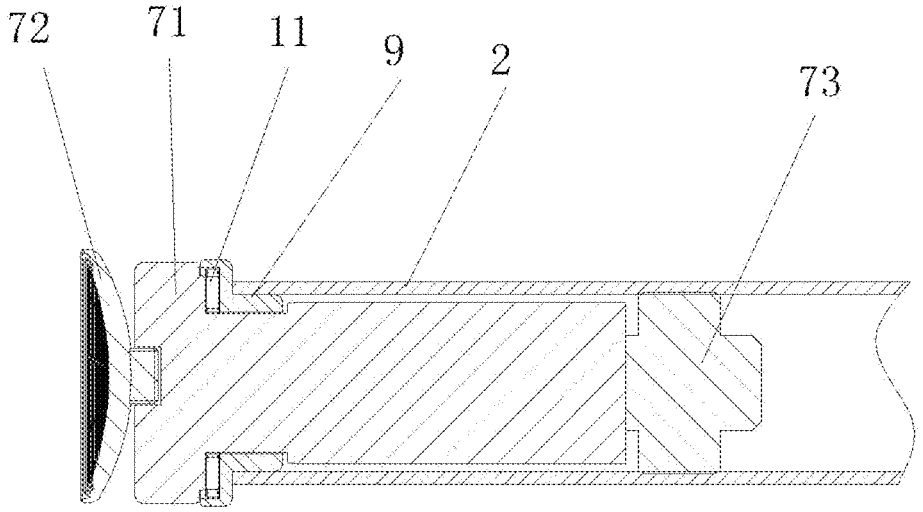
FIG. 5 is a section view of a locating component.

The present embodiment is basically identical with the embodiment 1 in structures, and the difference is that, as shown in FIG. 4 and FIG. 5, a motor is installed in the rolling shutter body 1; the rolling pipe is driven by the motor to roll, i.e., the rolling shutter body is an electric rolling shutter; the telescopic fixing component 4 is located at one end of the rolling shutter body; and the other end of the rolling shutter body is provided with the locating component 7. As shown in FIG. 5, the locating component comprises a locating seat 71, and a second locating plug 72 connected with one end of the locating seat 71, and a driving wheel 73 fixedly connected with the other end of the locating seat 71; the driving wheel 73 connected with the rolling pipe 2, a rotating seat 9 is disposed between the locating seat 71 and the rolling pipe 2; and a second bearing 11 is disposed between the locating seat 71 and the rotating seat. The structure of the second locating plug 72 on the locating component is the same as the structure of the locating plug of the telescopic component. The motor drives the driving wheel 73 to rotate, and the driving wheel 73 drives the rolling pipe 2 to rotate. Because the second bearing 11 is disposed between the rotating seat 9 and the locating seat 71, when the rotating seat 9 is rotated, the locating seat 71 and the second locating plug 72 at the end of the locating seat are always abutted against the wall.

Embodiment 3

Figure 6:
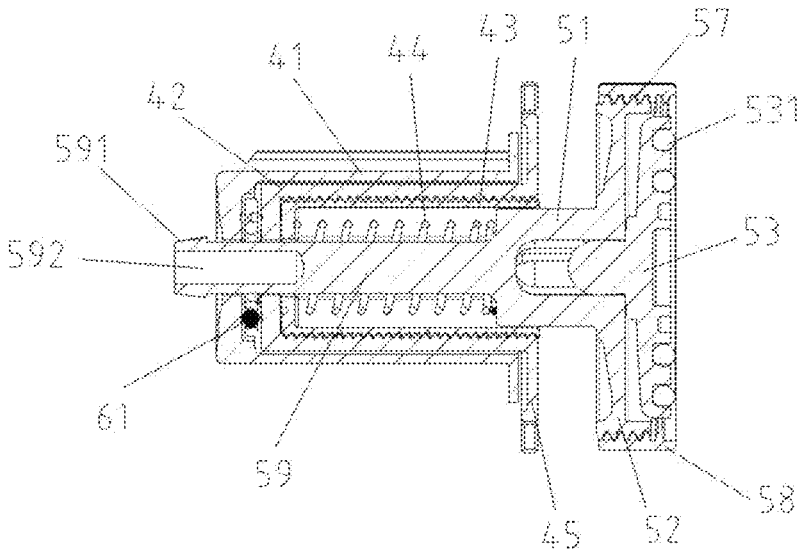
FIG. 6 is a section view of a telescopic fixing component in an embodiment 3.
Figure 7:
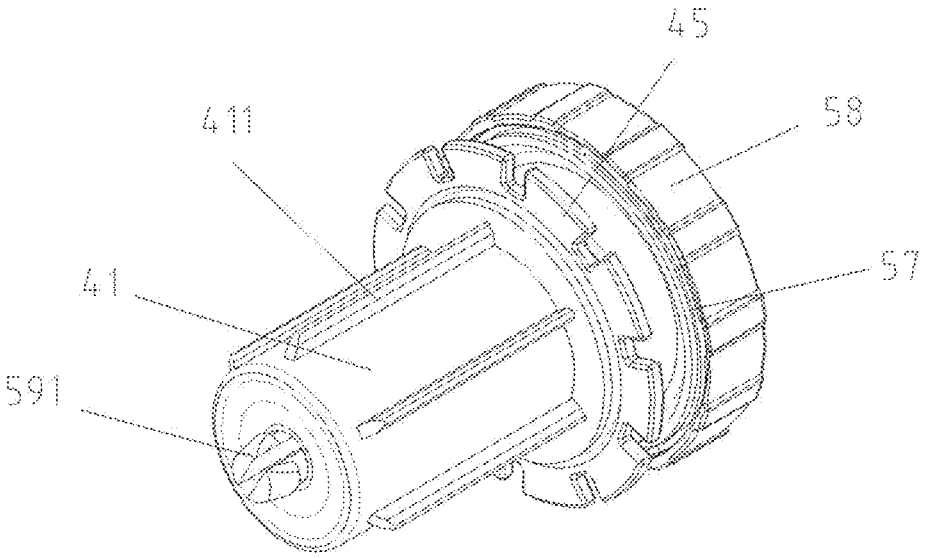
FIG. 7 is a stereogram of FIG. 6.

As shown in FIG. 6 and FIG. 7, the present embodiment is mainly an improvement on the fixing plug component. The fixing plug component is located in the rotating sleeve. The rotating sleeve 42 is located in the locating sleeve 41. Supporting ribs 411 are integrally formed on the outer circumferential surface of the locating sleeve 41. The supporting ribs 411 are uniformly distributed on the outer circumferential surface of the locating sleeve. The supporting ribs 411 are used to increase supporting force and frictional force between the locating sleeve and the rolling pipe. The fixing plug component comprises a fixing rod cylinder 51 located in the screw cylinder 43, a locating disk 52 integrally connected with the fixing rod cylinder 51, and a locating plug 53 fixed to the locating disk 52. A friction ring 531 is arranged on the end surface of the locating plug 53. One end of the fixing rod cylinder 51 is provided with an elastic hook column 59; an elastic hook 591 is integrally formed at the end of the elastic hook column 59; the elastic hook 591 is formed by two pieces of parallel hook bodies; a slot 592 is formed between the two hook bodies; and the two hook bodies can be compressed by each other to approach each other. After penetrating through the central holes of the screw cylinder, the rotating sleeve and the locating sleeve, the two hook bodies are mutually bounced off due to elasticity and the hook is fixed to the end surface of the locating sleeve. After the elastic hook column penetrates through the screw cylinder, the rotating sleeve and the locating sleeve, a chuck is clamped to the bottom surface of the locating sleeve, so as to axially limit the locating plug component 53 and prevent the locating plug component 53 from dropping. One end of the elastic hook column 59 is sleeved with a supporting bearing 61, and the supporting bearing 61 is located between the rotating sleeve and the locating sleeve. The other end of the fixing rod cylinder 51 is integrally formed with the locating disk 52; through holes are formed in the center of the screw cylinder 43; the elastic hook of the fixing rod cylinder penetrates through the through holes in the center of the screw cylinder and is clamped on the end of the locating sleeve; and the thrust spring 44 is sleeved on the elastic hook column. One end of the rotating sleeve 42 close to the fixing plug component is integrally connected with a turntable 45; threads are arranged on the outer circumferential surface of the locating disk 52; a thread sleeve 58 is connected to the outer threads of the locating disk; and the end surface of the thread sleeve 58 is connected with the end surface of the turntable 45. The external diameter of the thread sleeve 58 is not greater than the external diameter of the turntable; and the direction that the turntable 45 screws out the thread sleeve from the rotating sleeve is consistent with the rotating direction when the thread sleeve moves to the direction of the turntable. Two circles of annular friction rings 531 are uniformly distributed on the end surface of the locating plug to increase the frictional force between the locating plug and the wall surface, thereby fixing the rolling shutter.

When the rolling shutter is not installed, the thrust spring is in a natural state. When the rolling shutter needs to be installed, the ends of the rolling pipe is put between the walls on both sides of the window, compress the thrust spring 44, the thrust spring 44 drives the locating plug to move in the direction of the wall so as to realize the positioning of the rolling pipe. Then, the turntable 45 is rotated clockwise according to installation needs; the turntable rotates to drive the rotating sleeve to rotate; the rotating sleeve 42 is in thread connection with the screw cylinder 43; due to the rotation of the rotating sleeve 42, the screw cylinder 43 is rotated out to the right. The screw cylinder 43 is connected to the end face of the locating disk 52, so that the locating plug 53 is pressed onto the wall surface. At this moment, the thread sleeve 58 is rotated clockwise; the thread sleeve 58 moves towards the turntable; the end surface of the thread sleeve 58 is connected with the turntable 45; the turntable 45 is locked through the frictional force between the end surface and the turntable 45; at the same time, when the thread sleeve 58 is rotated clockwise, because the thread sleeve 58 comes into contact with the turntable, the turntable can be further driven to rotate clockwise; and clockwise rotation of the turntable can further drive the screw cylinder 43 to move to the 52 direction of the locating disk, so as to firmly fix the locating plug 53 to the wall surface. When the rolling shutter needs to be disassembled, the thread sleeve is rotated anticlockwise; and at the same time the turntable is rotated so as to complete the disassembly of the whole apparatus.

It should be understood that the embodiments are only used for illustrating the present invention, not used for limiting the scope of the present invention. In addition, it should be understood that those skilled in the art could, after reading the content of the present invention, implement various modifications to and variations of the present invention, and such equivalent forms also fall within the scope defined by appended claims of the present application.

What is claimed is:

1. A rolling shutter, comprising a rolling shutter body with a rolling pipe, wherein at least one end of the rolling shutter body is provided with a locating sleeve embedded into the rolling pipe and telescopic fixing cylinders located in the locating sleeve; the locating sleeve is fixedly connected with the rolling pipe; the telescopic fixing cylinders rotate relative to the locating sleeve, the telescopic fixing cylinders rotate relative to each other; and the telescopic fixing cylinders comprise telescopic cylinders and a fixing plug cylinder, wherein a thrust spring is disposed between the telescopic cylinders and the fixing plug cylinder, wherein a rotating sleeve of the telescopic cylinders is located in the locating sleeve, wherein a turntable is disposed on one end of the rotating sleeve adjacent to a locating disk of the fixing plug cylinder, and the turntable is integrally connected with the rotating sleeve, wherein when the turntable is rotated, the turntable is always located at a side of the locating disk, and the locating disk is always spaced from the turntable along a rotating axis of the turntable, wherein the telescopic cylinders comprise a screw cylinder located in the rotating sleeve, the screw cylinder is in threaded connection with the rotating sleeve to lock with the rotating sleeve, and the screw cylinder is always spaced from the locating disk along the rotating axis.

2. The rolling shutter according to claim 1, wherein a first bearing for reducing rotating frictional force is disposed between the locating sleeve and the telescopic fixing cylinders.

3. The rolling shutter according to claim 1, wherein the fixing plug cylinder is located in the screw cylinder; and the thrust spring is disposed between the fixing plug cylinder and the screw cylinder.

4. The rolling shutter according to claim 1, wherein the fixing plug cylinder comprises a fixing rod cylinder, the locating disk is connected with the fixing rod cylinder, and a first locating plug is fixed the locating disk or the fixing rod cylinder.

5. The rolling shutter according to claim 1, wherein the rolling shutter body is a manual bead curtain with a bead chain; and a first end of the at least one end of the rolling shutter body is provided with the telescopic fixing cylinders.

6. The rolling shutter according to claim 1, wherein the rolling shutter body is an electric rolling shutter; a first end of the at least one end of the rolling shutter body is provided with the telescopic fixing cylinders; a second end of the at least one end of the rolling shutter body is provided with a locating component; the locating component comprises a locating seat, and a second locating plug connected with a first end of the locating seat, and a driving wheel connected with a second end of the locating seat; wherein the driving wheel is fixedly connected with the rolling pipe, a rotating seat is disposed between the locating seat and the rolling pipe; and a second bearing is disposed between the locating seat and the rotating seat.

7. The rolling shutter according to claim 4, wherein a first end of the fixing rod cylinder is provided with an elastic hook column; an elastic hook is arranged at an end of the elastic hook column; a second end of the fixing rod cylinder is arranged with the locating disk; the elastic hook of the fixing rod cylinder penetrates through through holes in centers of the screw cylinder, the rotating sleeve and the locating sleeve in sequence and is clamped on an end of the locating sleeve; and the thrust spring is sleeved on the elastic hook column.

8. The rolling shutter according to claim 7, wherein outer threads are arranged on an outer circumferential surface of the locating disk; a thread sleeve is connected to the outer threads of the locating disk; and an end surface of the thread sleeve is connected with an end surface of the turntable.

9. The rolling shutter according to claim 8, wherein an external diameter of the thread sleeve is not greater than an external diameter of the turntable; and a rotating direction in which the turntable rotates the screw cylinder out of the rotating sleeve is the same as a rotating direction that causes the thread sleeve to move in a direction toward the turntable.

10. The rolling shutter according to claim 1, wherein a locating plug at an end in the fixing plug cylinder contacts with a wall surface; and a spherical sucker or a friction ring is arranged on an end surface of the locating plug.

11. The rolling shutter according to claim 4, wherein a section of the fixing rod cylinder is quadrangular, pentagonal or hexagonal.

12. The rolling shutter according to claim 1, wherein a first end of the at least one end of the rolling shutter body is provided with the telescopic fixing cylinders, a second end of the at least one end of the rolling shutter body is provided with a locating component, the locating component comprises a locating seat, and a second locating plug connected with a first end of the locating seat, and a driving wheel rotatably disposed at a second end of the locating seat.

* * * * *